US007140431B2

(12) United States Patent
Betts

(10) Patent No.: US 7,140,431 B2
(45) **Date of Patent: *Nov. 28, 2006**

(54) CENTRALISER FOR AN EXPANDABLE TUBULAR ELEMENT IN A WELLBORE

(75) Inventor: Michael John Betts, Rijswijk (NL)

(73) Assignee: Shell Oil Company, Houston, TX (US)

( * ) Notice: Subject to any disclaimer, the term of this patent is extended or adjusted under 35 U.S.C. 154(b) by 192 days.

This patent is subject to a terminal disclaimer.

(21) Appl. No.: 10/482,878

(22) PCT Filed: Jul. 5, 2002

(86) PCT No.: PCT/EP02/07532

§ 371 (c)(1),
(2), (4) Date: Jan. 6, 2004

(87) PCT Pub. No.: WO03/012246

PCT Pub. Date: Feb. 13, 2003

(65) Prior Publication Data

US 2004/0182571 A1 Sep. 23, 2004

(30) Foreign Application Priority Data

Jul. 6, 2001 (EP) ..... 01305878

(51) Int. Cl.
*E21B 17/10* (2006.01)

(52) U.S. Cl. ..... 166/241.6; 166/207; 175/325.5

(58) Field of Classification Search ..... 166/380, 166/384, 207, 241.4, 241.6; 175/325.5
See application file for complete search history.

(56) References Cited

U.S. PATENT DOCUMENTS

| | | | | |
|---|---|---|---|---|
| 1,997,880 | A | 4/1935 | Watry | |
| 2,035,637 | A | 3/1936 | Crickmer | |
| 5,335,723 | A | 8/1994 | Mouton | |
| 5,355,950 | A * | 10/1994 | Zwart | 166/241.6 |
| 2003/0106719 | A1 * | 6/2003 | Herrera | 175/325.2 |
| 2004/0173349 | A1 * | 9/2004 | Pointing | 166/241.6 |
| 2005/0241822 | A1 * | 11/2005 | Gremillion | 166/241.6 |

OTHER PUBLICATIONS

International Search Report dated Oct. 23, 2002.

* cited by examiner

*Primary Examiner*—David Bagnell
*Assistant Examiner*—Nicole A Coy
(74) *Attorney, Agent, or Firm*—Rachael Stiegel

(57) ABSTRACT

A centralizer is disclosed for stabilizing a radially expandable tubular element extending in a wellbore drilled into an earth formation. The centralizer has a tubular member selected from a section of the tubular element and a sleeve surrounding the tubular element, and at least one centralizer blade, each blade including a first arm connected to the tubular member in a manner allowing the first arm to hinge relative the tubular member between a radially retracted position and a radially extended position thereof, and a second arm connected to the tubular member at a point circumferentially spaced from the point of connection of the first arm to the tubular member. The second arm has an end part connected to the first arm so as to induce movement of the first arm from the retracted position to the extended position upon radial expansion of the tubular member.

8 Claims, 1 Drawing Sheet

CENTRALISER FOR AN EXPANDABLE TUBULAR ELEMENT IN A WELLBORE

FIELD OF THE INVENTION

The present invention relates to a centraliser for centralising or stabilising a tubular element extending in a wellbore drilled into an earth formation. The tubular element is, for example, a casing which is to be cemented in the wellbore. Generally it is desirable that the casing is positioned centrally in the wellbore before and during cementing in order to ensure that the annular cement layer between the casing and the wellbore wall provides sufficient isolation both in radial and longitudinal direction.

BACKGROUND OF THE INVENTION

Various types of centralisers have been applied to stabilise or centralise a tubular element, such as a casing, in a wellbore. One such centraliser is a spring centraliser which is provided with spring-type arms extending against the wellbore wall. However, such known centralisers are less applicable for tubulars which are to be radially expanded in the wellbore.

SUMMARY OF THE INVENTION

In accordance with the invention there is provided a centraliser for a radially expandable tubular element extending in a wellbore drilled into an earth formation, the centraliser comprising a radially expandable tubular member selected from a section of the tubular element and a sleeve surrounding the tubular element, the centraliser further comprising at least one centraliser blade, each blade including a first arm connected to the tubular member in a manner allowing the first arm to hinge relative the tubular member between a radially retracted position and a radially extended position thereof, and a second arm connected to the tubular member at a point circumferentially spaced from the point of connection of the first arm to the tubular member, the second arm having an end part connected to the first arm so as to induce movement of the first arm from the retracted position to the extended position upon radial expansion of the tubular member.

It is thereby achieved that, upon radial expansion of the tubular member in the wellbore, the circumferential distance between the points at which the respective first and second arms are connected to the tubular member increases so that the second arm induces the first arm to hinge to its radially extended position. The blade thereby becomes biased towards the wellbore wall and stabilises/centralises the tubular element in the wellbore.

Suitably, the second arm is connected to the tubular member in a manner allowing the second arm to hinge relative the tubular member between a radially retracted position and a radially extended position thereof.

It is preferred that the first and second arms, when in their respective retracted positions, extend from the tubular member in the same circumferential direction. This can be achieved, for example, if the second arm is longer than the first arm.

BRIEF DESCRIPTION OF THE DRAWINGS

The invention will be described hereinafter in more detail and by way of example with reference to the accompanying drawings in which.

DETAILED DESCRIPTION OF THE INVENTION

Figure 1:
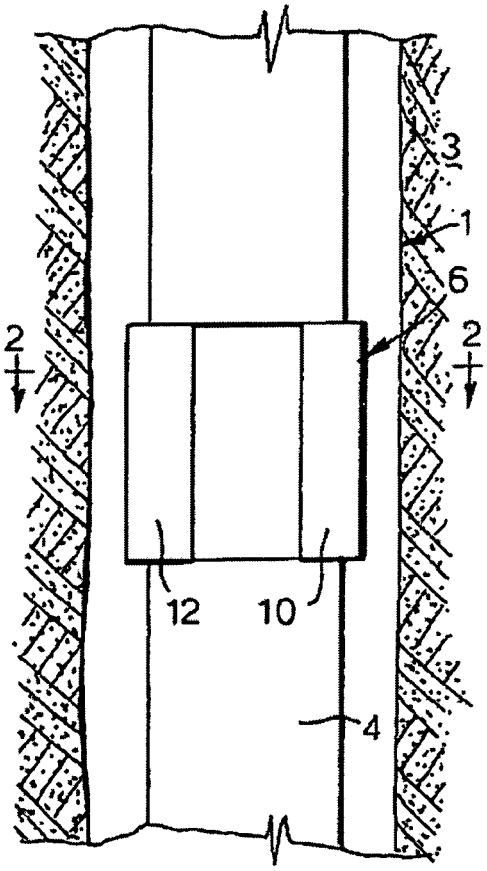
FIG. 1 schematically shows a longitudinal section of a wellbore with an embodiment of the centraliser of the invention in an unexpanded mode thereof.

Referring to FIG. 1 there is shown a wellbore 1 formed in an earth formation 3, whereby a radially expandable casing 4 extends into the wellbore 1. The casing 4 is provided with a centraliser 6 for stabilising and/or centralising the casing 4 in the wellbore 1.

Figure 2:
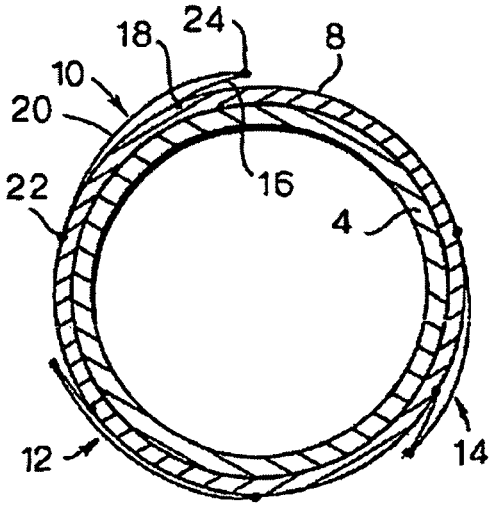
FIG. 2 schematically shows cross-section 2—2 of FIG. 1.

Referring further to FIG. 2, the centraliser 6 includes a radially expandable tubular member in the form of a sleeve 8 surrounding the casing 6. The sleeve 8 is provided with longitudinal slots (not shown) which are overlapping in longitudinal direction so that only a low expansion force is required to radially expand the sleeve 8. The centraliser further includes three centraliser blades 10, 12, 14 which are mutually similar. For ease of reference only blade 10 will be described herein, the other blades 12, 14 being similar to blade 10. Blade 10 includes a first arm 16 hingeably connected to the sleeve 8 at primary hinge 18 so as to allow the first arm 16 to hinge between a radially retracted position (as shown in FIG. 2) and a radially extended position thereof. Furthermore, blade 10 includes a second arm 20 hingeably connected to the sleeve 8 at secondary hinge 22 so as to allow the second arm 20 to hinge between a radially retracted position (as shown in FIG. 2) and a radially extended position thereof. Hinge 20 is circumferentially spaced from hinge 18. The two arms 16, 20 are hingeably interconnected at tertiary hinge 24.

Figure 3:
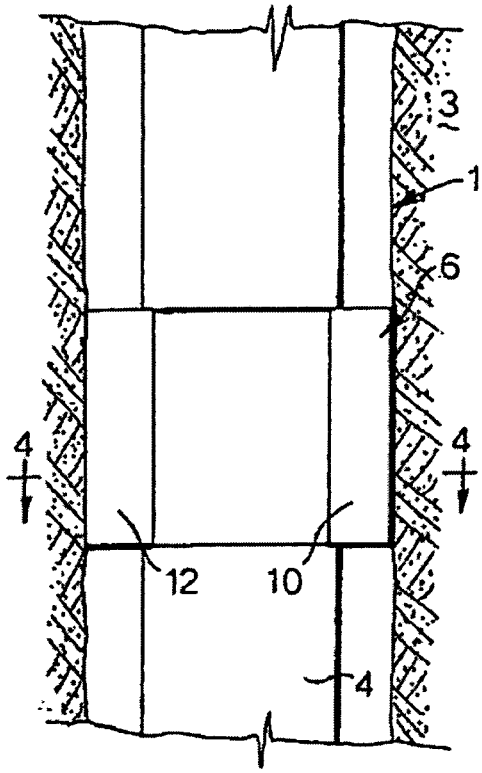
FIG. 3 schematically shows the wellbore of FIG. 1 with the centraliser in an expanded mode thereof.
Figure 4:
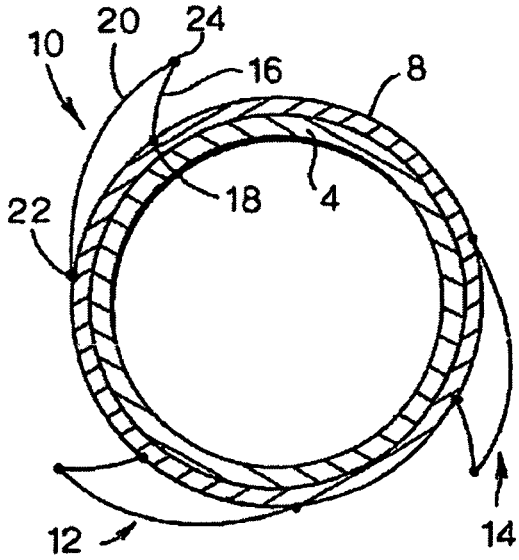
FIG. 4 schematically shows view 4—4 of FIG. 3.

Reference is further made to FIGS. 3 and 4. The casing 4 has been radially expanded in the wellbore 1. As a result of expanding the casing 4, the sleeve 8 also has been expanded radially so that the circumferential distance between hinges 18 and 22 has become larger and consequently the second arm 20 has pulled the first arm 16 to its radially extended position (as shown in FIG. 4).

During normal operation the sleeve 8 with the blades 10, 12, 14 connected thereto is arranged around the casing 4, whereby the first and second arms 16, 20 of each blade are in their respective retracted positions. The casing 4 is then lowered into the wellbore 1 and thereafter radially expanded, for example by means of a conventional expander (not shown) which is pushed, pulled or pumped through the casing 4. The sleeve 8 thereby also expands so that the circumferential distance between hinges 18 and 22 becomes larger. The second arm 20 thereby pulls the first arm 16 so as to hinge about primary hinge 18 to its radially extended position. As a consequence of outwardly hinging of the first arm 16, the second arm 20 hinges about secondary hinge 22 to its radially extended position. The blade 10 thereby has been radially expanded against the wall of the wellbore 1 (as shown in FIG. 3). The other blades 12, 14 are expanded simultaneously against the wall of the wellbore 1 in a similar manner.

Instead of the arms being hingeably connected to the sleeve, the arms can be directly connected in a hingeable manner to the casing so that no sleeve is required.

Instead of two said centraliser blades, any suitable number of centraliser blades can be applied.

Furthermore, the sleeve does not necessarily need to be provided with slots, and any suitable radially expandable sleeve can be applied instead.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

I claim:

1. A centraliser for a radially expandable tubular element extending in a wellbore drilled into an earth formation, the centraliser comprising a radially expandable tubular member, the centraliser further comprising at least one centraliser blade, each blade including a first arm connected to the tubular member in a manner allowing the first arm to hinge relative the tubular member between a radially retracted position and a radially extended position thereof, and a second arm connected to the tubular member at a point circumferentially spaced from the point of connection of the first arm to the tubular member, the second arm having an end part connected to the first arm so as to induce movement of the first arm from the retracted position to the extended position upon radial expansion of the tubular member.

2. The centraliser of claim 1, wherein the second arm is connected to the tubular member in a manner allowing the second arm to hinge relative the tubular member between a radially retracted position and a radially extended position thereof.

3. The centraliser of claim 1, wherein the second arm is connected to first arm in a manner allowing the second arm to hinge relative the first arm.

4. The centraliser of claim 1, wherein the tubular element is a casing extending into the wellbore.

5. The centraliser of claim 1, wherein the of a slotted sleeve a solid sleeve.

6. The centraliser of claim 1, wherein the first and second arms, when in their respective retracted positions, extend from the tubular member in the same circumferential direction.

7. The centraliser of claim 6, wherein the second arm is longer than the first arm.

8. The centraliser of claim 1 wherein the tubular member is a section of the tubular element.

* * * * *